US012421643B2

(12) United States Patent
Masciovecchio et al.

(10) Patent No.: US 12,421,643 B2
(45) **Date of Patent: *Sep. 23, 2025**

(54) LAUNDRY TREATING APPLIANCE WITH A PANEL

(71) Applicant: WHIRLPOOL CORPORATION, Benton Harbor, MI (US)

(72) Inventors: Kurt L. Masciovecchio, Saint Joseph, MI (US); Daniel Polonsky, Stevensville, MI (US); Mark Schulz, San Carlos, CA (US); Anne Wessel, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/649,343

(22) Filed: Apr. 29, 2024

(65) Prior Publication Data

US 2024/0287727 A1 Aug. 29, 2024

Related U.S. Application Data

(63) Continuation of application No. 17/556,263, filed on Dec. 20, 2021, now Pat. No. 12,000,074.

(51) Int. Cl.

| | |
|---|---|
| ***D06F 34/34*** | (2020.01) |
| ***D06F 39/12*** | (2006.01) |
| *D06F 101/00* | (2020.01) |
| *D06F 105/58* | (2020.01) |

(52) U.S. Cl.
CPC ..... *D06F 34/34* (2020.02); *D06F 39/12* (2013.01); *D06F 2101/00* (2020.02); *D06F 2105/58* (2020.02)

(58) Field of Classification Search
None
See application file for complete search history.

(56) References Cited

U.S. PATENT DOCUMENTS

| | | | | |
|---|---|---|---|---|
| 8,511,762 | B2 | 8/2013 | Stegerwald | |
| 12,000,074 | B2 * | 6/2024 | Masciovecchio | D06F 34/34 |
| 2006/0137108 | A1 * | 6/2006 | Cho | D06F 25/00 68/12.14 |
| 2006/0141197 | A1 * | 6/2006 | Caparros Taracido | A47L 15/4265 428/40.1 |
| 2007/0075614 | A1 * | 4/2007 | Calmeise | D06F 39/14 312/326 |
| 2008/0256984 | A1 | 10/2008 | Lim et al. | |

FOREIGN PATENT DOCUMENTS

| | | | | |
|---|---|---|---|---|
| EP | 2580383 | B1 | 12/2016 | |
| EP | 3112528 | A1 * | 1/2017 | D06F 58/02 |
| EP | 3112529 | A1 * | 1/2017 | D06F 58/02 |

(Continued)

*Primary Examiner* — Cristi J Tate-Sims
(74) *Attorney, Agent, or Firm* — McGarry Bair PC

(57) ABSTRACT

A laundry treating appliance can include a chassis defining an interior and having at least a front wall, with the front wall having a component access port providing access to an internal component of the laundry treating appliance. The laundry treating appliance can also have a panel coupled to the front wall, with the panel movable between a first position and a second position. The panel can also include a pocket handle.

20 Claims, 6 Drawing Sheets

(56) References Cited

FOREIGN PATENT DOCUMENTS

| | | | | | |
|---|---|---|---|---|---|
| EP | 2977500 | B1 | | 6/2017 | |
| EP | 3187651 | B1 | * | 2/2019 | ..... D06F 25/00 |
| EP | 3187650 | B1 | | 12/2020 | |
| WO | 02090640 | A1 | | 11/2002 | |

* cited by examiner

LAUNDRY TREATING APPLIANCE WITH A PANEL

CROSS-REFERENCE TO RELATED APPLICATION(S)

This application is a continuation of U.S. patent application Ser. No. 17/556,263, filed Dec. 20, 2021, now U.S. Pat. No. 12,000,074, issued Jun. 4, 2024, which is incorporated herein by reference in its entirety.

BACKGROUND

Laundry treating appliances, such as washing machines, combination washer/dryers, refreshers, and non-aqueous systems, can have a configuration based on a rotating drum that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. In addition, hot air, cold air, or a mixture thereof can be supplied to the treating chamber in accordance with the cycle of operation and via an air flow assembly.

BRIEF SUMMARY

In one aspect, the disclosure relates to a laundry treating appliance having a chassis defining an interior and having at least a front wall, with the front wall having a component access port providing access to an internal component of the laundry treating appliance; a closure having a bottom edge and selectively movable relative to the chassis between an opened position and a closed position; and a panel coupled to the front wall and movable between a first position providing access to the component access port and a second position covering the component access port, the panel having a top edge underlying and vertically spaced from the bottom edge of the closure to define a gap therebetween, and also having a blind pocket handle for movement between the first and second positions, with the blind pocket handle accessible through the gap when the closure is in the closed position.

In another aspect, the disclosure relates to a laundry treating appliance having a chassis defining an interior and having at least a front wall, with the front wall having a component access port providing access to an internal component of the laundry treating appliance; a closure having a bottom edge and selectively movable relative to the chassis between an opened position and a closed position; a panel coupled to the front wall and movable between a first position providing access to the component access port and a second position covering the component access port, the panel having a top edge underlying and vertically spaced from the bottom edge of the closure to define a gap therebetween, and also having a blind pocket handle accessible through the gap when the closure is in the closed position; and a magnet coupled to the panel and configured to magnetically engage the front wall when the closure is in the second position.

In yet another aspect, the disclosure relates to a laundry treating appliance having a chassis defining an interior and having at least a front wall, with the front wall having a component access port providing access to an internal component of the laundry treating appliance; a closure having a bottom edge and selectively movable relative to the chassis between an opened position and a closed position; and a panel coupled to the front wall and movable between a first position providing access to the component access port and a second position covering the component access port, the panel having a top edge underlying and vertically spaced from the bottom edge of the closure to define a gap therebetween, and also having a blind pocket handle accessible through the gap when the closure is in the closed position, the blind pocket handle having: a shelf wall forming a bottom surface of the blind pocket handle and located below the top edge of the blind pocket handle; and a first sidewall intersecting the shelf wall and projecting upwardly to the top edge.

DETAILED DESCRIPTION

Figure 1:
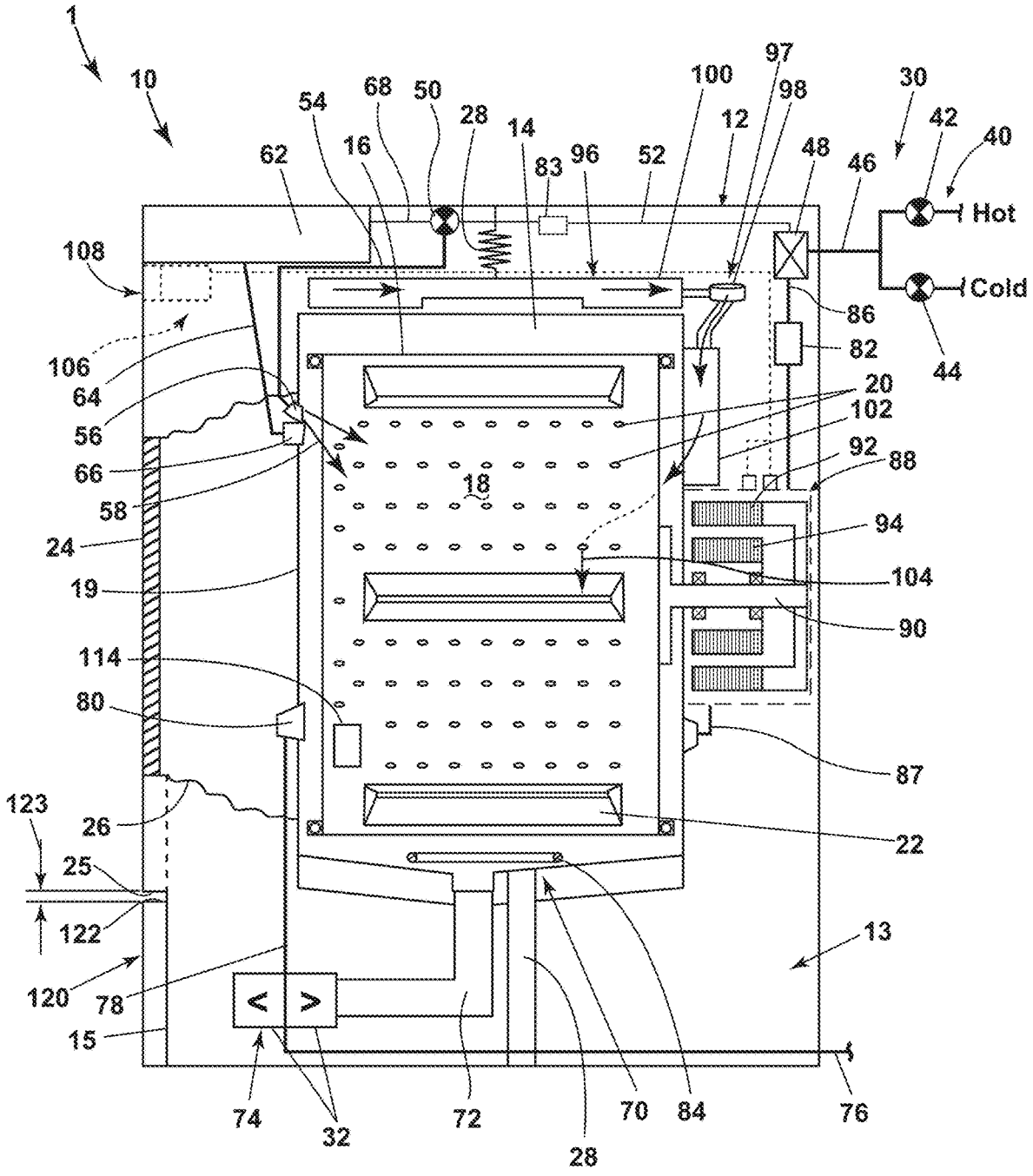
FIG. 1 illustrates a schematic cross-sectional view of a laundry treating appliance in accordance with various aspects described herein.

Aspects of the disclosure generally relate to an openable or removable appliance panel providing access to interior components of the appliance. Appliance cabinets or chassis are generally known to include removable front covers at a lower portion of the cabinet for accessing components. Such front covers may require two-handed or even two-person operation to open or remove the cover, such as with covers that utilize handles or snap-fit components on opposing sides of an appliance. Such front covers can also include small handles that are difficult to maneuver or quickly locate, such as in environments having poor lighting or tight spaces. The present disclosure relates to an improved appliance panel that is easily operated and securely closed while forming a smooth aesthetic appearance for the cabinet or chassis.

The described aspects of the present disclosure have applicability in a variety of household appliances including, but not limited to, laundry treating appliances, dishwashers, refrigerators, freezers, or the like. Some non-limiting examples of laundry treating appliances include laundry washing appliances, laundry drying appliances, combination laundry washer/dryers, refreshing/revitalizing machines, extractors, non-aqueous washing apparatuses, or the like.

Washing machines are typically categorized as either a vertical axis washing machine or a horizontal axis washing machine. The terms “vertical axis” and “horizontal axis” are often used as shorthand terms for the manner in which the appliance imparts mechanical energy to the load of laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum can rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of the disclosure. Connection references (e.g., attached, coupled, connected, or joined) are to be construed broadly and can include intermediate members between a collection of elements and relative movement between elements unless otherwise indicated. As such, connection references do not necessarily infer that two elements are directly connected and in fixed relation to one another. Furthermore, as used herein, the term "set" or a "set" of elements can be any number of elements, including only one. The exemplary drawings are for purposes of illustration only and the dimensions, positions, order and relative sizes reflected in the drawings attached hereto can vary.

FIG. 1 is a schematic cross-sectional view of an exemplary laundry treating appliance 1. In the illustrated example, the exemplary laundry treating appliance 1 is shown as a horizontal axis, front-load combination washing and drying machine 10 though this need not be the case. The laundry treating appliance 1 can be any appliance which performs an automatic cycle of operation to clean or otherwise treat items placed therein, non-limiting examples of which include a horizontal or vertical axis clothes washer, a combination washing machine and dryer, a tumbling or stationary refreshing/revitalizing machine, an extractor, a non-aqueous washing apparatus, a revitalizing machine, or the like.

The combination washing and drying machine 10 can include a structural support system including a cabinet or chassis 12. The chassis 12 can include a housing defining an interior 13. The chassis 12 can enclose components typically found in a conventional washing machine, such as motors, pumps, fluid lines, controls, sensors, transducers, and the like. Such components will not be described further herein except as necessary for a complete understanding of the present disclosure.

The chassis 12 can define a housing within which a laundry holding system resides. Such a laundry holding system can include a tub 14 dynamically suspended within the structural support system of the chassis 12 by a suitable suspension system 28 and a drum 16 provided within the tub 14. The tub 14 can define at least a portion of a treating chamber 18. For example, the treating chamber 18 can be located within the drum 16. The treating chamber 18 can have an access opening 19. The drum 16 can be configured to receive a laundry load through the access opening 19 with articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. It is also within the scope of the present disclosure for the laundry holding system to include only one receptacle with the receptacle defining the laundry treating chamber for receiving the load to be treated. At least one lifter 22 can extend from a wall of the drum 16 to lift the laundry load received in the treating chamber 18 while the drum 16 rotates.

The laundry holding system can further include a closure 24 which can be movably mounted to the chassis 12 to selectively close both the tub 14 and the drum 16. In the example shown, the closure 24 is in the form of a door positioned on the front of the chassis 12. In some examples, the closure 24 can include a lid, panel, viewing window, or the like. The closure 24 can define a bottom edge 25 as shown. The closure 24 can be selectively movable between an opened position, with the access opening 19 accessible from an exterior of the combination washing and drying machine 10, and a closed position, with the access opening 19 inaccessible from the exterior. A bellows 26 can couple an open face of the tub 14 with the chassis 12, with the closure 24 sealing against the bellows 26 when the closure 24 is in the closed position.

The chassis 12 can include a front wall 15 at a lower portion of the chassis 12. The front wall 15 can extend vertically upward. In some examples, the front wall 15 can form an entire front side of the chassis 12 from top to bottom. In some examples, the front wall 15 can form a lower portion of a front side of the chassis 12, such as a bulkhead.

A panel 120 can be coupled to the front wall 15. The panel 120 can have a top edge 122 as shown. In some examples, the top edge 122 of the panel 120 can be spaced from the bottom edge 25 of the closure 24. A gap 123 can be defined between the top edge 122 and the bottom edge 25 as shown. The panel 120 can be configured to be removably coupled from the front wall 15, such as a plinth or decorative panel in non-limiting examples.

The combination washing and drying machine 10 can further include a washing circuit 30 having at least one wash circuit component 32 located within the chassis 12. The at least one wash circuit component 32 can include a liquid supply system for supplying water to the combination washing and drying machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 or the drum 16 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid 58 into the tub 14. In this manner, water from the household water supply 40 can be supplied directly to the tub 14. While the valves 42, 44 and the inlet conduit 46 are illustrated exteriorly of the chassis 12, it will be understood that these components can be internal to the chassis 12.

The combination washing and drying machine 10 can also be provided with a dispensing system for dispensing treating chemistry to the treating chamber 18 for use in treating the load of laundry according to a cycle of operation. The dispensing system can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the chassis 12, or within a separate dispenser housing which can be provided in the chassis 12. The treating chemistry dispenser 62 can be moveable between a fill position, where the treating chemistry dispenser 62 is exterior to the chassis 12 and can be filled with treating chemistry, and a dispense position, where the treating chemistry dispenser 62 are interior of the chassis 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The combination washing and drying machine 10 can also include a recirculation and drain system for recirculating liquid within the laundry holding system and draining liquid from the combination washing and drying machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the combination washing and drying machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the load of laundry within.

The liquid supply and/or recirculation and drain system can be provided with a heating system which can include one or more devices for heating laundry and/or liquid supplied to the tub 14, such as a steam generator 82, an inline heater 83 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the combination washing and drying machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The combination washing and drying machine 10 can also include a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The motor 88 can rotate the drum 16 at various speeds in opposite rotational directions. In particular, the motor 88 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the at least one lifter 22. Typically, the force applied to the fabric items at the tumbling speeds is less than about 1G. Alternatively, the motor 88 can rotate the drum 16 at spin speeds wherein the fabric items rotate with the drum 16 without falling. The spin speeds can also be referred to as satellizing speeds or sticking speeds. Typically, the force applied to the fabric items at the spin speeds is greater than or about equal to 1G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The combination washing and drying machine 10 can further include a drying circuit 96 that can be a closed loop or an open loop circuit. The drying circuit 96 can have at least one drying circuit component 97 located within the chassis 12. The at least one drying circuit component 97 can include an air recirculation conduit that is fluidly coupled to and recirculates air 104 through the treating chamber 18. The air recirculation conduit can include a blower 98, a condenser 100, and a heating element 102. The condenser 100 can be provided with a condenser drain conduit (not shown in FIG. 1) that fluidly couples the condenser 100 with the pump 74 and the drain conduit 76. Condensed liquid collected within the condenser 100 can flow through the condenser drain conduit to the pump 74, where it can be provided to the recirculation and drain system. While the drying circuit 96 is shown adjacent an upper portion of the tub 14, it will be understood that the disclosure is not so limited and the drying circuit 96 can be provided at any suitable location within the chassis 12. In some examples, the drying circuit 96 can provide drying air 104 into the treating chamber 18 via the perforations 20 for drying the laundry items. In some examples, an open loop circuit can be implemented where air is heated, passed through the drum 16, and exhausted out of the combination washing and drying machine 10, in which case a condenser is not necessary.

The combination washing and drying machine 10 can also include a control system for controlling the operation of the combination washing and drying machine 10 to implement one or more cycles of operation. The control system can include a controller 106 located within the chassis 12 and a user interface 108 that is operably coupled with the controller 106. The user interface 108 can include one or more knobs, dials, switches, displays, touch screens and the like for communicating with the user, such as to receive input and provide output. The user can enter different types of information including, without limitation, cycle selection and cycle parameters, such as cycle options.

The controller 106 can include the machine controller and any additional controllers provided for controlling any of the components of the washing machine 10. For example, the controller 106 can include the machine controller and a motor controller. Many known types of controllers can be used for the controller 106. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
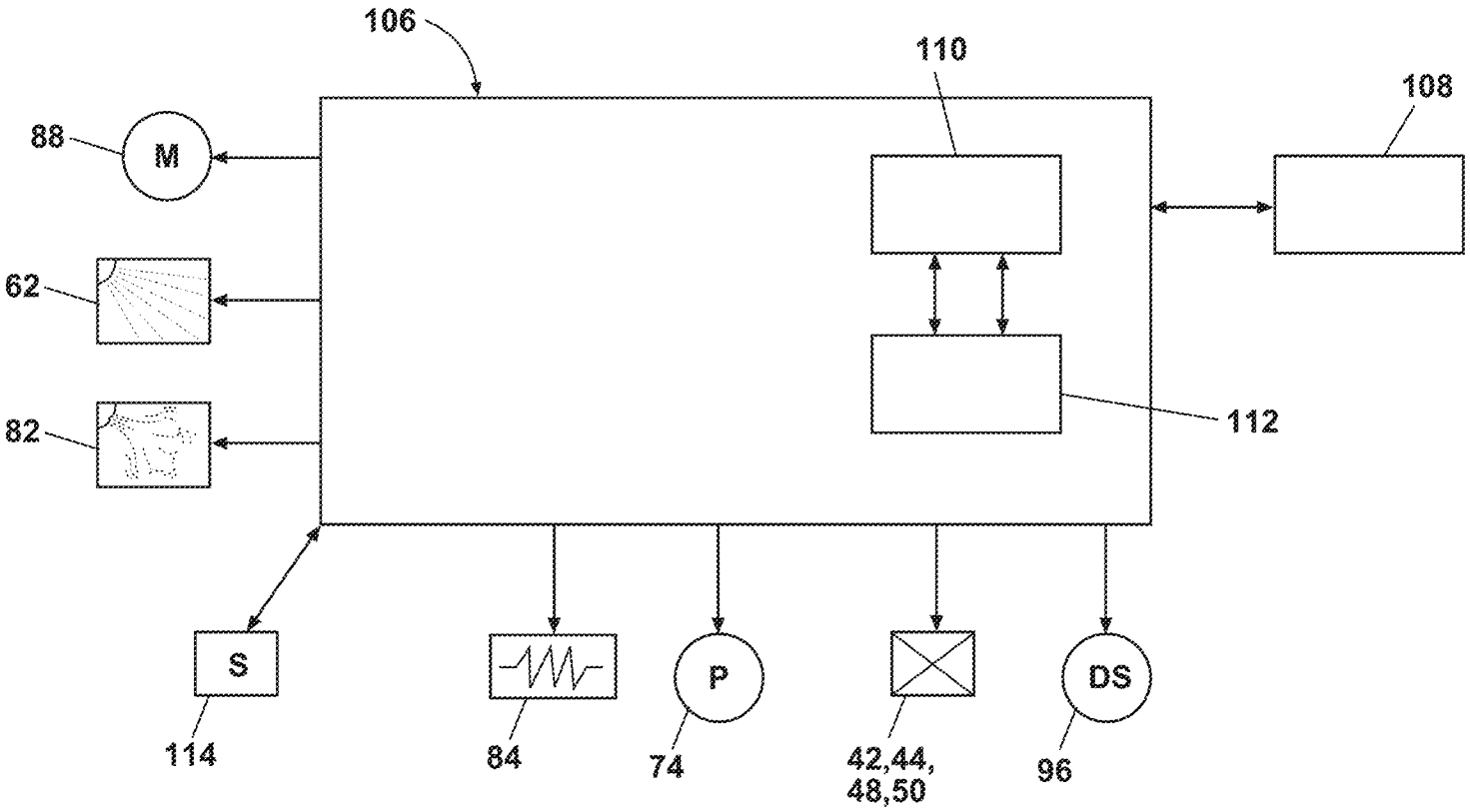
FIG. 2 illustrates a schematic of a control system of the laundry treating appliance of FIG. 1.

As illustrated in FIG. 2, the controller 106 can be provided with a memory 110 and a central processing unit (CPU) 112. The memory 110 can be used for storing the control software that is executed by the CPU 112 in completing a cycle of operation using the combination washing and drying machine 10 and any additional software. Examples, without limitation, of cycles of operation include: wash, heavy duty wash, delicate wash, quick wash, pre-wash, refresh, rinse only, and timed wash. The memory 110 can also be used to store information, such as a database or table, and to store data received from one or more components of the combination washing and drying machine 10 that can be communicably coupled with the controller 106. The database or table can be used to store the various operating parameters for the one or more cycles of operation, including factory default values for the operating parameters and any adjustments to them by the control system or by user input.

The controller 106 can be operably coupled with one or more components of the combination washing and drying machine 10 for communicating with and controlling the operation of the component to complete a cycle of operation. For example, the controller 106 can be operably coupled with the motor 88, the pump 74, the treating chemistry dispenser 62, the steam generator 82, the sump heater 84, and the drying circuit 96 to control the operation of these and other components to implement one or more of the cycles of operation.

The controller 106 can also be coupled with one or more sensors 114 provided in one or more of the systems of the washing machine 10 to receive input from the sensors, which are known in the art and illustrated in FIG. 1 in a lower portion of the treating chamber 18 for exemplary purposes only. Non-limiting examples of sensors 114 that can be communicably coupled with the controller 106 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
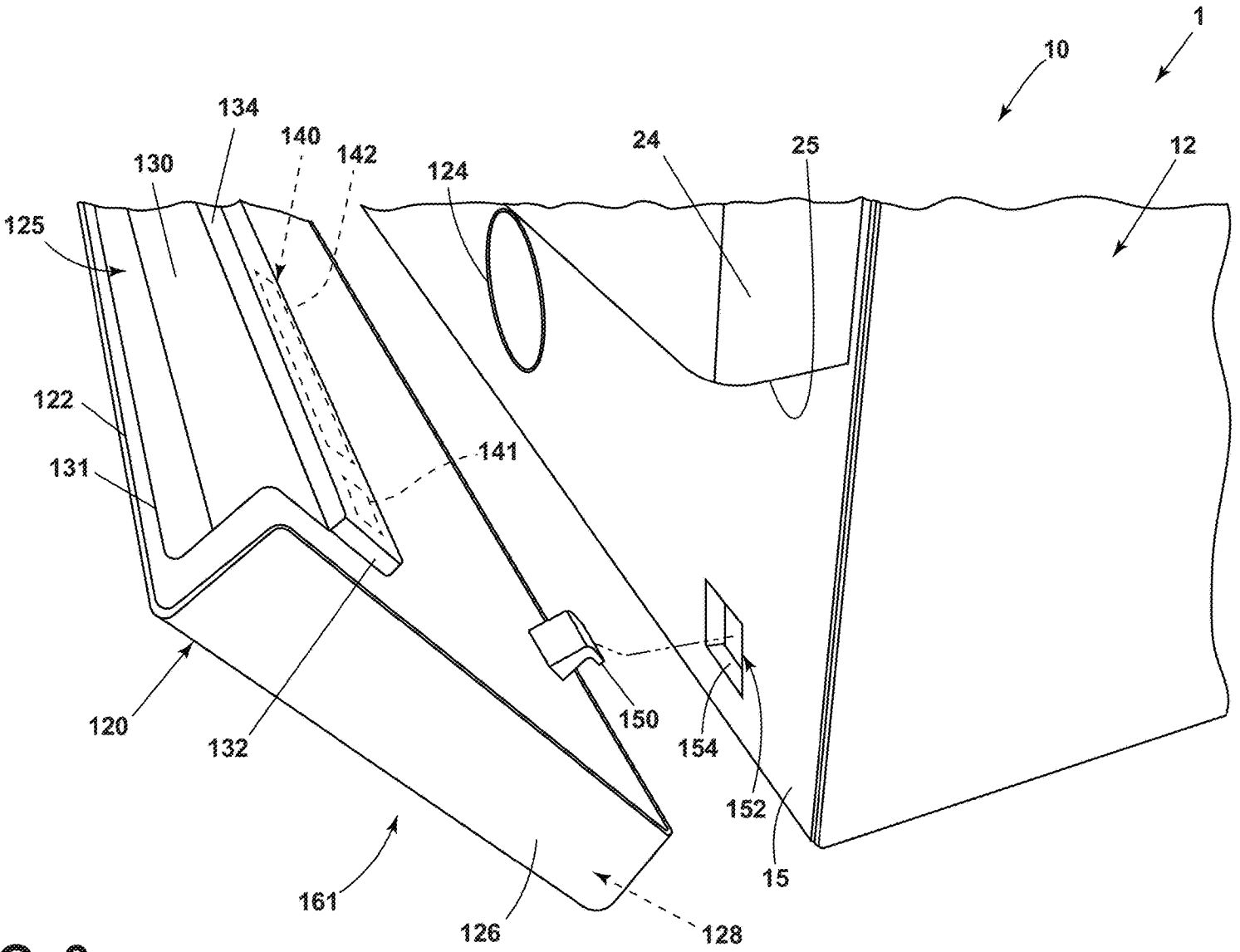
FIG. 3 is a partially-exploded view of the laundry treating appliance of FIG. 1 with a panel in accordance with various aspects described herein.

Referring now to FIG. 3, a partially exploded view of the laundry treating appliance 1 is shown with the panel 120 spaced from the front wall 15 of the chassis 12. The front wall 15 can include at least one component access port 124. The component access port 124 can provide access from the exterior of the laundry treating appliance 1 to any internal component of the chassis 12. The component access port 124 can provide access to at least one wash circuit component 32 or drying circuit component 97 as described above. In one non-limiting example, the component access port 124 can provide access to a pump, such as the pump 74 (FIG. 1). It is also contemplated that multiple component access ports 124 can be provided in the front wall 15.

The panel 120 can include a blind pocket handle 125 as shown. The blind pocket handle 125 can include an outer surface 126 bounding a panel interior 128. The blind pocket handle 125 can also include a shelf wall 130, a first sidewall 131, and a second sidewall 132. The shelf wall 130 can form a bottom surface of the blind pocket handle 125. For example, the shelf wall 130 can be located below the top edge 122 of the blind pocket handle 125. The first sidewall 131 can intersect the shelf wall 130 and project upwardly to the top edge 122. The first sidewall 131 can also form the top edge 122 of the panel 120. The second sidewall 132 can be spaced from the first sidewall 131 and also intersect the shelf wall 130. In some examples, the second sidewall 132 can have a top surface 134 that is flush with, level with, or in the same plane as the shelf wall 130. While the second sidewall 132 is illustrated with a projecting portion, it is also contemplated that the second sidewall 132 can have any suitable geometric profile including planar, curved, irregular, dimpled, or the like, or combinations thereof.

At least one magnet 140 can be coupled to the panel 120. The at least one magnet 140 can be configured to magnetically engage the front wall 15. In the non-limiting example shown, the at least one magnet 140 includes a first magnet 141 coupled to the second sidewall 132, as well as a second magnet 142 coupled to the second sidewall 132 and in the form of an elongated bar magnet extending along the blind pocket handle 125. It will be understood that any number, type, or form of magnet 140 can be provided. It will also be understood that the at least one magnet 140 can be positioned on or within any suitable portion of the panel 120. In some examples, a single magnet or multiple magnets can be provided within the panel interior 128, on the outer surface 126 of the panel 120, distributed fully across the second sidewall 132, or discretely spaced on portions of the panel 120, or the like, or combinations thereof.

A hook 150 can also be provided with the panel 120. The hook 150 can project from the panel 120 in a direction toward the interior 13 of the chassis 12. An aperture 152 can be provided in the front wall 15 and be configured to receive the hook 150.

The panel 120 can be movable with respect to the front wall 15. In some examples, the panel 120 can be pivotally coupled to the front wall 15, slidably coupled to the front wall 15, fully removable from the front wall 15, or combinations thereof. In a non-limiting example, the hook 150 can be configured for pivotal engagement with an edge 154 of the aperture 152.

Figure 4:
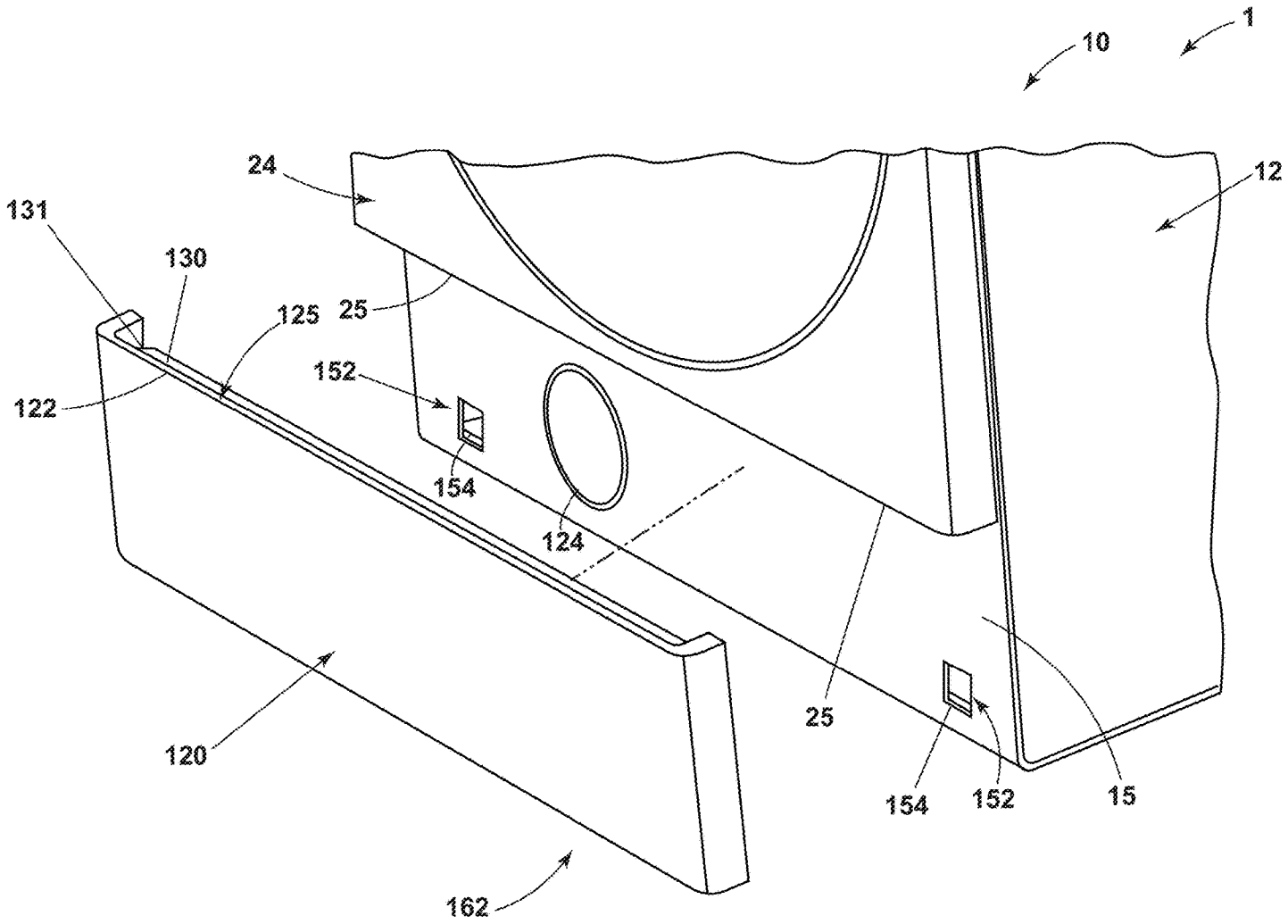
FIG. 4 is another partially-exploded view of the laundry treating appliance of FIG. 3 illustrating a sidewall of the panel having a blind pocket handle and a hook in accordance with various aspects described herein.

In the example of FIG. 3, the panel 120 is shown in a first position 161 with the top edge 122 spaced away from the front wall 15. Turning to FIG. 4, the panel 120 is shown in a second position 162. It is contemplated that the panel 120 can be movable between the first position 161, providing access to the component access port 124, and the second position 162, covering the component access port 124. It is also contemplated that the panel 120 can be rotatably movable between the first position 161 and the second position 162 by way of the pivotal engagement between the hook 150 (FIG. 3) and aperture 152.

In the example shown, two apertures 152 are provided and configured to receive two corresponding hooks 150 (visible in FIG. 3). Any number or arrangement of apertures and hooks can be provided.

When the panel 120 is in the second position 162 as shown, the at least one magnet 140 can be configured to magnetically attract the front wall 15 of the chassis 12. For example, the at least one magnet 140 can magnetically attract or hold the panel 120 to the front wall 15 against a predetermined pulling force, including between 0 N and 1 N, or between 0 N and 2 N, or between 0 N and 5 N, in nonlimiting examples. In addition, each hook 150 can rest on the corresponding edge 154 of each aperture 152. In some examples, the at least one magnet 140 can have a sufficient magnetic attraction with the front wall 15 to support the weight of the panel 120 alone. In some examples, the panel can be partially supported by the magnetic coupling of the at least one magnet 140, and also partially supported by the hooks 150 resting on corresponding edges 154.

Figure 5:
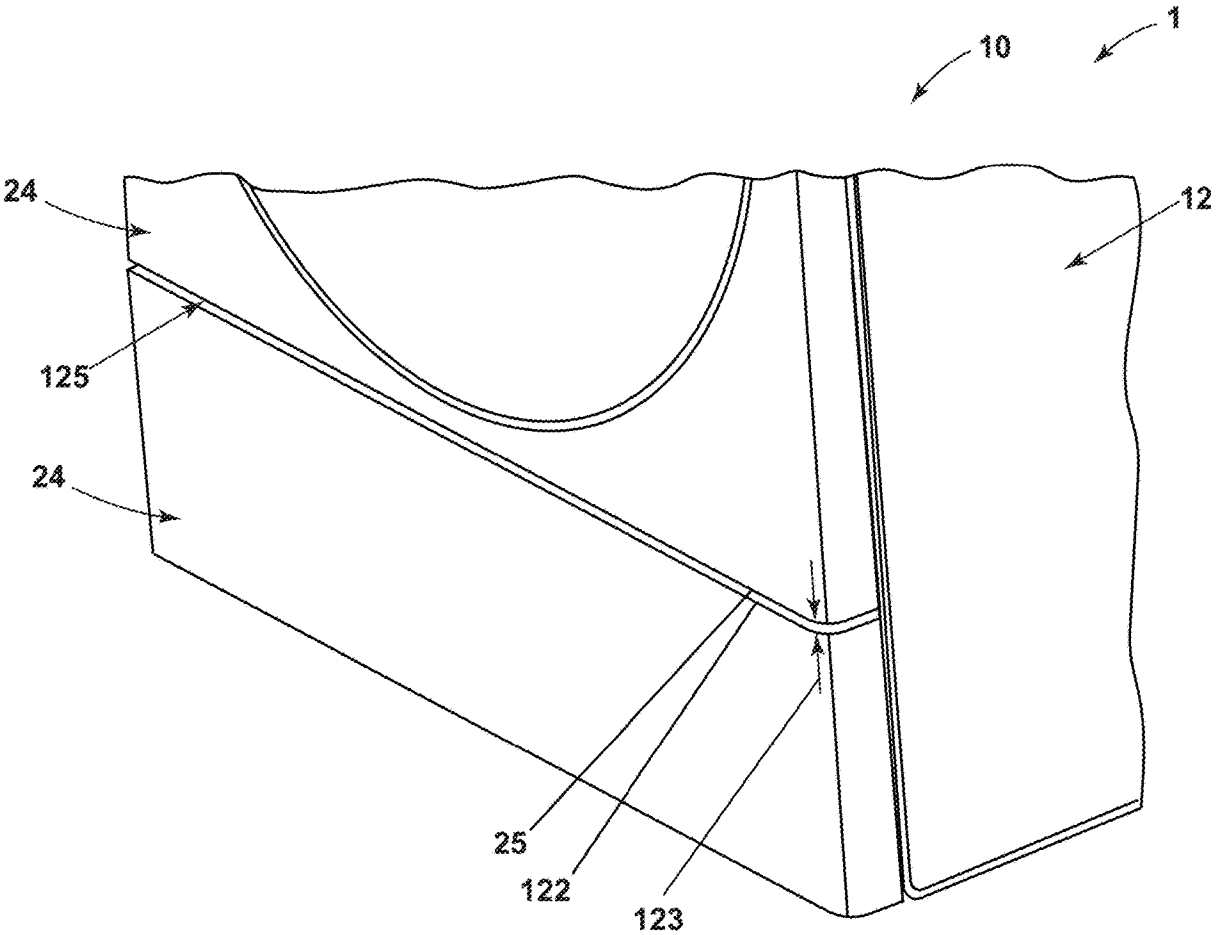
FIG. 5 is an assembled view of the laundry treating appliance of FIG. 3 illustrating a gap between the panel and a closure of the laundry treating appliance.

Turning to FIG. 5, the panel 120 is illustrated in an assembled view in the second position 162. The first sidewall 131 can be configured to align with the closure 24 when the panel 120 is in the second position 162. The first sidewall 131 can at least partially hide the blind pocket handle 125 such that the blind pocket handle 125 is not readily visible to a user when the panel 120 is closed.

In addition, the example of FIG. 5 further illustrates the gap 123 between the bottom edge 25 of the closure 24 and the top edge 122 of the panel 120. The gap 123 can have any suitable size, including between 1 cm and 2 cm, or between 0.5 cm and 5 cm, in non-limiting examples. The gap 123 can be sized to accommodate a user's hand or fingers into the gap 123 to grasp the blind pocket handle 125 in some examples. The gap 123 can also be sized to prevent insertion of a user's hand or fingers into the gap 123 in some examples. While the gap 123 is shown as being constant or nearly constant between all portions of the top edge 122 and bottom edge 25, the disclosure is not so limited. It is contemplated that the gap 123 can also have a variable size between the top edge 122 and bottom edge 25.

Figure 6:
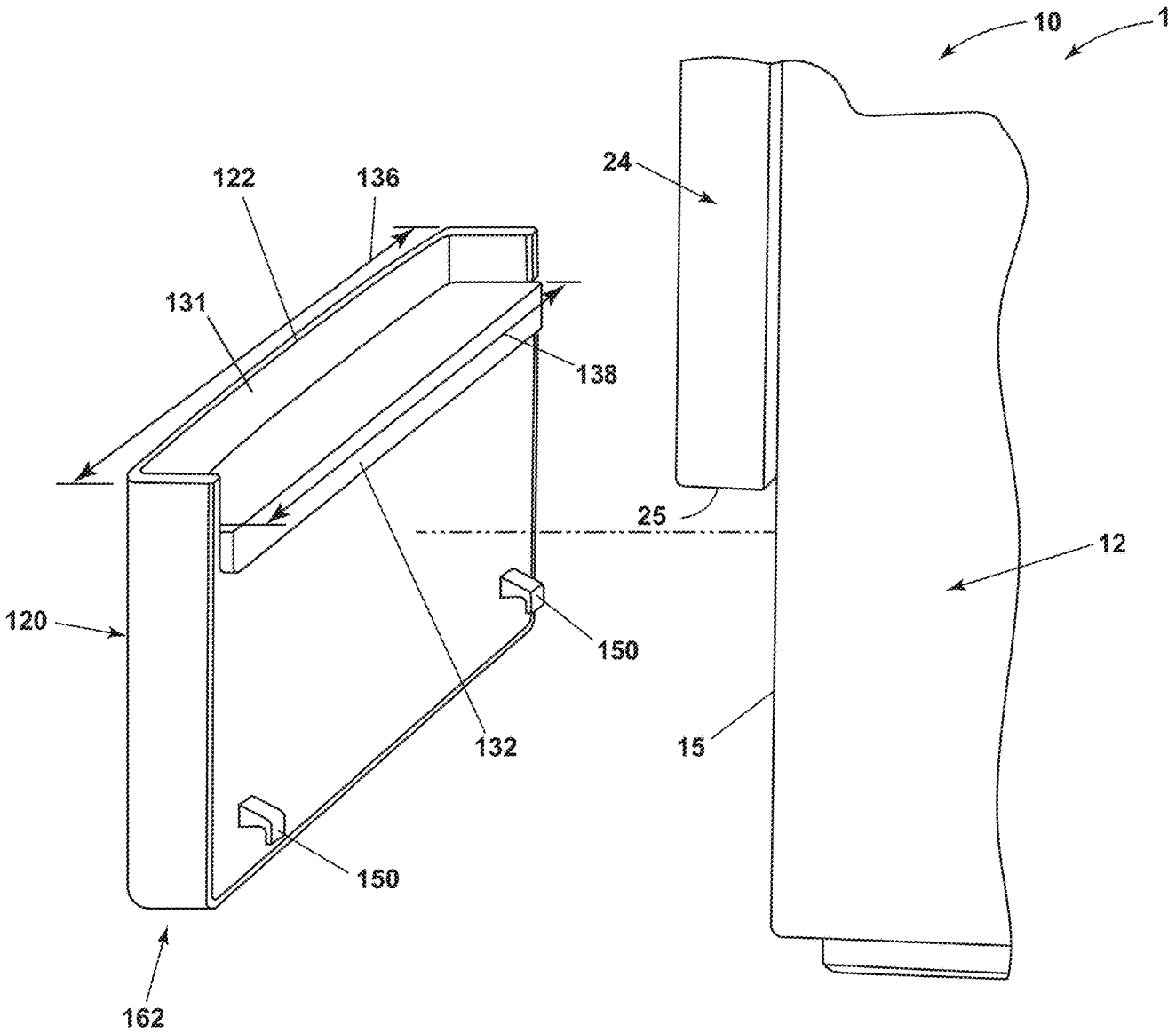
FIG. 6 is another partially-exploded perspective view of the laundry treating appliance of FIG. 3 illustrating a panel width and a shelf wall width in accordance with various aspects described herein.

Referring now to FIG. 6, another partially-exploded view of the panel 120 is shown while in the second position 162. It is contemplated that the blind pocket handle 125 can extend substantially across the panel 120. For example, the panel 120 can define a panel width 136 as shown. The shelf wall 130 can define a shelf width 138 as shown. The shelf width 138 can be between 40% and 100% of the panel width 136, or between 40% and 99% of the panel width 136, or between 50% and 95% of the panel width 136, in non-limiting examples.

When the panel 120 is in the second position 162, a user can move the panel 120 to the first position 161 by grasping any portion of the first sidewall 131 of the blind pocket handle 125 and pulling or rotating away from the front wall 15, thereby exposing the component access port 124. A user can then rotate, push, or otherwise move the panel 120 back into the second position 162, where the magnetic attraction from the at least one magnet 140 can secure the panel 120 to the front wall 15.

The described aspects of the present disclosure have a variety of benefits. The blind pocket handle provides for greatly improved accessibility for users compared to traditional appliance panels. As a user can grasp any portion of the pocket handle for opening, there is no need for locating a spatially-small handle, or for simultaneously operating spaced handles or release mechanisms for opening of the panel as found in traditional appliances. The elongated shelf-style pocket handle having the shelf wall level with the second sidewall can also provide for improved component rigidity and reduced part stresses in operation. Furthermore, in the example of a combination washing and drying machine, the panel can provide for improved access of multiple internal components that may be closely positioned within the machine, due to the presence of both the washing circuit and the drying circuit. The simplified coupling structure provided by the magnetic coupling and hook/aperture engagement can also decrease component assembly times compared to traditional appliance panels that require precise alignment for snap-fit components or other complex assembly processes. The first sidewall extending vertically and aligning with the closure also provides for an aesthetically smooth appearance of the laundry treating appliance while visually hiding the elongated blind pocket handle from view until needed.

To the extent not already described, the different features and structures of the various aspects can be used in combination with each other as desired, or can be used separately. That one feature can not be illustrated in all of the aspects is not meant to be construed that it cannot be, but is done for brevity of description. Thus, the various features of the different aspects can be mixed and matched as desired to form new aspects, whether or not the new aspects are expressly described.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure. Hence, specific dimensions and other physical characteristics relating to the aspects disclosed herein are not to be considered as limiting, unless expressly stated otherwise.

What is claimed is:

1. A laundry treating appliance, comprising:

a chassis defining an interior and having at least a front wall, with the front wall having a component access port providing access to an internal component of the laundry treating appliance;

a closure having a bottom edge and selectively movable relative to the chassis between an opened position and a closed position; and a panel coupled to the front wall and movable between a first position providing access to the component access port and a second position covering the component access port, the panel comprising a top edge underlying and vertically spaced from the bottom edge of the closure to define a gap therebetween, and also comprising a blind pocket handle for movement between the first and second positions, with the blind pocket handle accessible through the gap when the closure is in the closed position.

2. The laundry treating appliance of claim 1, further comprising a hook projecting from the panel in a direction toward the interior of the chassis.

3. The laundry treating appliance of claim 2, further comprising an aperture in the front wall of the chassis and configured to receive the hook therethrough, wherein the hook is configured for pivotal engagement with an edge of the aperture, with the panel being rotatably movable between the first position and the second position by way of the pivotal engagement.

4. The laundry treating appliance of claim 1, further comprising:

a tub located within the interior and at least partially defining a treating chamber;

a washing circuit fluidly coupled to the treating chamber and having a wash circuit component located within the chassis; and a drying circuit fluidly coupled to the treating chamber and having a drying circuit component located within the chassis.

5. The laundry treating appliance of claim 4, wherein at least one of the wash circuit component or the drying circuit component is accessible through the component access port.

6. The laundry treating appliance of claim 1, wherein the internal component comprises a pump.

7. A laundry treating appliance, comprising:

a chassis defining an interior and having at least a front wall, with the front wall having a component access port providing access to an internal component of the laundry treating appliance;

a closure having a bottom edge and selectively movable relative to the chassis between an opened position and a closed position;

a panel coupled to the front wall and movable between a first position providing access to the component access port and a second position covering the component access port, the panel comprising an outer surface bounding a panel interior, a top edge underlying and vertically spaced from the bottom edge of the closure to define a gap therebetween, and also comprising a blind pocket handle accessible through the gap when the closure is in the closed position; and an elongated bar magnet positioned within the panel interior and surrounded by the outer surface, the elongated bar magnet extending along the panel interior and configured to magnetically engage the front wall when the closure is in the second position.

8. The laundry treating appliance of claim 7, wherein the elongated bar magnet extends along the blind pocket handle.

9. The laundry treating appliance of claim 7, further comprising a hook projecting from the panel in a direction toward the interior of the chassis.

10. The laundry treating appliance of claim 9, further comprising an aperture in the front wall of the chassis and configured to receive the hook therethrough, wherein the hook is configured for pivotal engagement with an edge of the aperture, with the panel being rotatably movable between the first position and the second position by way of the pivotal engagement.

11. The laundry treating appliance of claim 7, further comprising:

a tub located within the interior and at least partially defining a treating chamber;

a washing circuit fluidly coupled to the treating chamber and having a wash circuit component located within the chassis; and a drying circuit fluidly coupled to the treating chamber and having a drying circuit component located within the chassis.

12. The laundry treating appliance of claim 11, wherein at least one of the wash circuit component or the drying circuit component is accessible through the component access port.

13. The laundry treating appliance of claim 12, wherein at least one of the wash circuit component or the drying circuit component comprises a pump.

14. A laundry treating appliance, comprising:

a chassis defining an interior and having at least a front wall, with the front wall having a component access port providing access to an internal component of the laundry treating appliance;

a closure having a bottom edge and selectively movable relative to the chassis between an opened position and a closed position; and a panel coupled to the front wall and movable between a first position providing access to the component access port and a second position covering the component access port, the panel comprising a top edge underlying and vertically spaced from the bottom edge of the closure to define a gap therebetween, and also comprising a blind pocket handle accessible through the gap when the closure is in the closed position, the blind pocket handle comprising:

a shelf wall forming a bottom surface of the blind pocket handle and located below the top edge of the blind pocket handle; and a first sidewall intersecting the shelf wall and projecting upwardly to the top edge;

wherein the closure and the panel project the same distance from the chassis such that a front surface of the closure is flush with a front surface of the panel.

15. The laundry treating appliance of claim 14, wherein the panel comprises a panel width and the shelf wall comprises a shelf width between 40% and 100% of the panel width.

16. The laundry treating appliance of claim 14, further comprising a hook projecting from the panel in a direction toward the interior of the chassis, and an aperture in the front wall of the chassis and configured to receive the hook therethrough, wherein the hook is configured for pivotal engagement with an edge of the aperture.

17. The laundry treating appliance of claim 14, further comprising:

a tub located within the interior and at least partially defining a treating chamber;

a washing circuit fluidly coupled to the treating chamber and having a wash circuit component located within the chassis; and a drying circuit fluidly coupled to the treating chamber and having a drying circuit component located within the chassis.

18. The laundry treating appliance of claim 17, wherein at least one of the wash circuit component or the drying circuit component is accessible through the component access port.

19. The laundry treating appliance of claim 18, wherein at least one of the wash circuit component or the drying circuit component comprises a pump.

20. The laundry treating appliance of claim 8, wherein the elongated bar magnet extends along an entire width of the blind pocket handle.

* * * * *